United States Patent [19]

Kopatz et al.

[11] Patent Number: 4,731,111

[45] Date of Patent: Mar. 15, 1988

[54] HYDROMETALLURICAL PROCESS FOR PRODUCING FINELY DIVIDED SPHERICAL REFRACTORY METAL BASED POWDERS

[75] Inventors: Nelson E. Kopatz, Sayre; Walter A. Johnson; Joseph E. Ritsko, both of Towanda, all of Pa.

[73] Assignee: GTE Products Corporation, Stamford, Conn.

[21] Appl. No.: 26,312

[22] Filed: Mar. 16, 1987

[51] Int. Cl.[4] ..... B22F 9/24

[52] U.S. Cl. ..... 75/0.5 AB; 75/0.5 AC; 75/0.5 BB; 75/0.5 BC; 75/251

[58] Field of Search ..... 75/0.5 AB, 0.5 BB, 0.5 AC, 75/0.5 BC, 251, 0.5 B, 0.5 BA

[56] References Cited

U.S. PATENT DOCUMENTS

| | | | |
|---|---|---|---|
| 3,652,259 | 3/1972 | Knopp | 75/0.5 B |
| 3,909,241 | 9/1975 | Cheney et al. | 75/0.5 BB |
| 4,042,374 | 8/1977 | Rasmussen et al. | 75/0.5 B |

*Primary Examiner*—Wayland Stallard

*Attorney, Agent, or Firm*—Donald R. Castle

[57] ABSTRACT

A process for producing finely divided spherical refractory metal based powders comprises forming an aqueous solution containing at least one refractory metal, forming a solid reducible refractory metal based material containing a compound selected from the group consisting of refractory metal salts, refractory metal oxides, hydroxides and mixtures thereof, reducing the solid material to refractory metal based powder particles, subjecting the refractory based metal particles to a high temperature zone to melt a portion of the particles and cooling the molten material to form essentially spherical refractory metal based powder particles.

14 Claims, No Drawings

HYDROMETALLURICAL PROCESS FOR PRODUCING FINELY DIVIDED SPHERICAL REFRACTORY METAL BASED POWDERS

FIELD OF THE INVENTION

This invention relates to the preparation of refractory metal based powders. More particularly it relates to the production of such powders having substantially spherical particles.

BACKGROUND OF THE INVENTION

U.S. Pat. No. 3,663,667 discloses a process for producing multimetal alloy powders. Thus, multimetal alloy powders are produced by a process wherein an aqueous solution of at least two thermally reducible metallic compounds and water is formed, the solution is atomized into droplets having a droplet size below about 150 microns in a chamber that contains a heated gas whereby discrete solid particles are formed and the particles are thereafter heated in a reducing atmosphere and at temperatures from those sufficient to reduce said metallic compounds at temperatures below the melting point of any of the metals in said alloy.

U.S. Pat. No. 3,909,241 relates to free flowing powders which are produced by feeding agglomerates through a high temperature plasma reactor to cause at least partial melting of the particles and collecting the particles in a cooling chamber containing a protective gaseous atmosphere where the particles are solidified. In this patent the powders are used for plasma coating and the agglomerated raw materials are produced from slurries of metal powders and binders. Both the U.S. Pat. Nos. 3,663,667 and the 3,909,241 patents are assigned to the same assignee as the present invention. Refractory metal alloys have been produced by this method, however, such materials having an average particle size of of less than about 25 micrometers.

In European Patent Application W08402864 published Aug. 2, 1984, also assigned to the assignee of this invention, there is disclosed a process for making ultrafine powder by directing a stream of molten droplets at a repellent surface whereby the droplets are broken up and repelled and thereafter solidified as described therein. While there is a tendency for spherical particles to be formed after rebounding, it is stated that the molten portion may form elliptical shaped or elongated particles with rounded ends.

Spherical refractory metal powders such as tungsten, molybdenum, niobium, tantalum, rhenium, hafnium and their alloys are useful in applications requiring good thermal and electrical conductivity and/or endurance at high temperature and/or abrasive environments. Parts such as filters, precision press and sinter parts, injection molded parts, and electrical/electronic components may be made from these powders.

Refractory metal powders heretofore have been produced by hydrometallurgical processing. While these metal alloys are finally divided and potentially uniform in composition, they are predominantly irregular in morphology. There are applications for low surface area fine powder which requires uniform, flowable and spherical powder.

As used herein "refractory metal" means tungsten, molybdenum, niobium, tantalum, rhenium, zirconium, chromium and titanium. The term "based materials" as used herein means that the refractory metals constitute the major portion of the material thus includes the refractory metal per se as well as alloys in which the refractory metal is the major constituent, normally above about 50% by weight of the alloy but in any event the refractory metal or refractory metals are the constituent having the largest percentage by weight of the total alloy.

It is believed therefore that a relatively simple process which enables finely divided metal alloy powders to be hydrometallurgically produced from sources of the individual metals is an advancement in the art.

SUMMARY OF THE INVENTION

In accordance with one aspect of this invention there is provided a process comprising forming an aqueous solution containing values of at least one refractory metal removing sufficient water from the solution to form a reducible metal material containing a compound selected from refractory metal salts, refractory metal oxides or mixtures thereof. Thereafter the material is reduced to form a particulate refractory metal based metallic material. At least a portion resulting refractory metal based particulate is entrained in a carrier gas and fed to a high temperature zone to melt at least a portion of the particulates. The molten material is solidified in the form of spherical refractory metal based particles having an average particle size of less than about 20 micrometers. Refractory metal based alloys are produced by this process by using alloying forming ratios of one or more metals in conjunction with a major portion of one or more refractory metals.

In accordance with another embodiment of this invention there is provided a powdered material consisting essentially of spherical particles of a refractory metal based material, said powdered material being essentially free of elliptical shaped material and essentially free of elongated particles having rounded ends, said powdered material having an average particle size of less than about 20 microns.

DETAILS OF THE PREFERRED EMBODIMENTS

For a better understanding of the present invention, together with other and further objects, advantages, and capabilities thereof, reference is made to the following disclosure and appended claims in connection with the foregoing description of some of the aspects of the invention.

While it is preferred to use metal powders as starting materials in the practice of this invention because such materials dissolve more readily than other forms of metals, however, use of the powders is not essential. Metallic salts that are soluble in water or in an aqueous mineral acid can be used. When alloys are desired, the metallic ratio of the various metals in the subsequently formed solids of the salts, oxides or hydroxides can be calculated based upon the raw material input or the solid can be sampled and analyzed for the metal ratio in the case of alloys being produced. The metal values can be dissolved in any water soluble acid. The acids can include the mineral acids as well as the organic acids such as acetic, formic and the like. Hydrochloric is especially preferred because of cost and availability.

After the metal sources are dissolved in the aqueous acid solution, the resulting solution can be subjected to sufficient heat to evaporate water thereby lowering the pH. The metal compounds, for example, the oxides, hydroxides, sulfates, nitrates, chlorides, and the like, will precipitate from the solution under certain pH conditions. The solid materials can be separated from the resulting aqueous phase or the evaporation can be continued. Continued evaporation results in forming particles of a residue consisting of the metallic compounds. In some instances, when the evaporation is done in air, the metal compounds may be the hydroxides, oxides or mixtures of the mineral acid salts of the metals and the metal hydroxides or oxides. The residue may be agglomerated and contain oversized particles. The average particle size of the materials can be reduced in size, generally below about 20 micrometers by milling, grinding or by other conventional methods of particle size reduction.

After the particles are reduced to the desired size they are heated in a reducing atmosphere at a temperature above the reducing temperature of the salts but below the melting point of the metals in the particles. The temperature is sufficient to evolve any water of hydration and the anion. If hydrochloric acid is used and there is water of hydration present the resulting wet hydrochloric acid evolution is very corrosive thus appropriate materials of construction must be used. The temperatures employed are below the melting point of any of the metals therein but sufficiently high to reduce and leave only the cation portion of the original molecule. In most instances a temperature of at least about 500° C. is required to reduce the compounds. Temperatures below about 500° C. can cause insufficient reduction while temperatures above the melting point of the metal result in large fused agglomerates. If more than one metal is present the metals in the resulting multimetal particles can either be combined as intermetallics or as solid solutions of the various metal components. In any event there is a homogeneous distribution throughout each particle of each of the metals. The particles are generally irregular in shape. If agglomeration has occurred during the reduction step, particle size reduction by conventional milling, grinding and the like can be done to achieve a desired average particle size for example less than about 20 micrometers with at least 50% being below about 20 micrometers.

In preparing the powders of the present invention, a high velocity stream of at least partially molten metal droplets is formed. Such a stream may be formed by any thermal spraying technique such as combustion spraying and plasma spraying. Individual particles can be completely melted (which is the preferred process), however, in some instances surface melting sufficient to enable the subsequent formation of spherical particles from such partially melted particles is satisfactory. Typically, the velocity of the droplets is greater than about 100 meters per second, more typically greater than 250 meters per second. Velocities on the order of 900 meters per second or greater may be achieved under certain conditions which favor these speeds which may include spraying in a vacuum.

In the preferred process of the present invention, a powder is fed through a thermal spray apparatus. Feed powder is entrained in a carrier gas and then fed through a high temperature reactor. The temperature in the reactor is preferably above the melting point of the highest melting component of the metal powder and even more preferably considerably above the melting point of the highest melting component of the material to enable a relatively short residence time in the reaction zone.

The stream of dispersed entrained molten metal droplets may be produced by plasma-jet torch or gun apparatus of conventional nature. In general, a source of metal powder is connected to a source of propellant gas. A means is provided to mix the gas with the powder and propel the gas wtih entrained powder through a conduit communicating with a nozzle passage of the plasma spray apparatus. In the arc type apparatus, the entrained powder may be fed into a vortex chamber which communicates with and is coaxial with the nozzle passage which is bored centrally through the nozzle. In an arc type plasma apparatus, an electric arc is maintained between an interior wall of the nozzle passage and an electrode present in the passage. The electrode has a diameter smaller than the nozzle passage with which it is coaxial to so that the gas is discharged from the nozzle in the form of a plasma jet. The current source is normally a DC source adapted to deliver very large currents at relatively low voltages. By adjusting the magnitude of the arc powder and the rate of gas flow, torch temperatures can range from 5500 degrees centigrade up to about 15,000 degrees centigrade. The apparatus generally must be adjusted in accordance with the melting point of the powders being sprayed and the gas employed. In general, the electrode may be retracted within the nozzle when lower melting powders are utilized with an inert gas such as nitrogen while the electrode may be more fully extended within the nozzle when higher melting powders are utilized with an inert gas such as argon.

In the induction type plasma spray apparatus, metal powder entrained in an inert gas is passed at a high velocity through a strong magnetic field so as to cause a voltage to be generated in the gas stream. The current source is adapted to deliver very high currents, on the order of 10,000 amperes, although the voltage may be relatively low such as 10 volts. Such currents are required to generate a very strong direct magnetic field and create a plasma. Such plasma devices may include additional means for aiding in the initation of a plasma generation, a cooling means for the torch in the form of annular chamber around the nozzle.

In the plasma process, a gas which is ionized in the torch regains its heat of ionization on exiting the nozzle to create a highly intense flame. In general, the flow of gas through the plasma spray apparatus is effected at speeds at least approaching the speed of sound. The typical torch comprises a conduit means having a convergent portion which converges in a downstream direction to a throat. The convergent portion communicates with an adjacent outlet opening so that the discharge of plasma is effected out the outlet opening.

Other types of torches may be used such as an oxyacetylene type having high pressure fuel gas flowing through the nozzle. The powder may be introduced into the gas by an aspirating effect. The fuel is ignited at the nozzle outlet to provide a high temperature flame.

Preferably the powders utilized for the torch should be uniform in size and composition. A relatively narrow size distribution is desirable because, under set flame conditions, the largest particles may not melt completely, and the smallest particles may be heated to the vaporization point. Incomplete melting is a detriment to the product uniformity, whereas vaporization and decomposition decreases process efficiency. Typically, the size ranges for plasma feed powders of this invention are such that 80 percent of the particles fall within about a 15 micrometer diameter range.

The stream of entrained molten metal droplets which issues from the nozzle tends to expand outwardly so that the density of the droplets in the stream decreases as the distance from the nozzle increases. Prior to impacting a surface, the stream typically passes through a gaseous atmosphere which solidifies and decrease the velocity of the droplets. As the atmosphere approaches a vacuum, the cooling and velocity loss is diminished. It is desirable that the nozzle be positioned sufficiently distant from any surface so that the droplets remain in a droplet form during cooling and solidification. If the nozzle is too close, the droplets may solidify after impact.

The stream of molten particles may be directed into a cooling fluid. The cooling fluid is typically disposed in a chamber which has an inlet to replenish the cooling fluid which is volitilized and heated by the molten particles and plasma gases. The fluid may be provided in liquid form and volitilized to the gaseous state during the rapid solidification process. The outlet is preferable in the form of a pressure relief valve. The vented gas may be pumped to a collection tank and reliquified for reuse.

The choice of the particle cooling fluid depends on the desired results. If large cooling capacity is needed, it may be desirable to provide a cooling fluid having a high thermal capacity. An inert cooling fluid which is non-flammable and nonreactive may be desirable if contamination of the product is a problem. In other cases, a reactive atmosphere may be desirable to modify the powder. Argon and nitrogen are preferable nonreactive cooling fluids. Hydrogen may be preferable in certain cases to reduce oxides and protect from unwanted reactions. If hydride formation is desirable, liquid hydrogen may enhance hydride formation. Liquid nitrogen may enhance nitride formation. If oxide formation is desired, air, under selective oxidizing conditions, is a suitable cooling fluid.

Since the melting plasmas are formed from many of the same gases, the melting system and cooling fluid may be selected to be compatible.

The cooling rate depends on the thermal conductivity of the cooling fluid and the molten particles to be cooled, the size of the stream to be cooled, the size of individual droplets, particle velocity and the temperature difference between the droplet and the cooling fluid. The cooling rate of the droplets is controlled by adjusting the above mentioned variables. The rate of cooling can be altered by adjusting the distance of the plasma from the liquid bath surface. The closer the nozzle to the surface of the bath, the more rapidly cooled the droplets.

Powder collection is conveniently accomplished by removing the collected powder from the bottom of the collection chamber. The cooling fluid may be evaporated or retained if desired to provide protection against oxidation or unwanted reactions.

The particle size of the spherical powder will be largely dependent upon the size of the feed into the high temperature reactor. Some densification occurs and the surface area is reduced thus the apparent particle size is reduced. The preferred form of particle size measurement is by micromergraphs, sedigraph or microtrac. A majority of the particles will be below about 20 micrometers or finer. The desired size will depend upon the use of the alloy. For example, in certain instances such as microcircuitry applications extremely finely divided materials are desired such as less than about 3 micrometers.

After cooling and resolidification, the resulting high temperature treated material can be classified to remove the major spheroidized particle portion from the essentially nonspheroidized minor portion of particles and to obtain the desired particle size. The classification can be done by standard techniques such as screening or air classification. The unmelted minor portion can then be reprocessed according to the invention to convert it to fine spherical particles.

The powdered materials of this invention are essentially spherical particles which are essentially free of elliptical shaped material and essentially free of elongated particles having rounded ends, is shown in European Patent Application No. WO8402864.

Spherical particles have an advantage over non-spherical particles in injection molding and pressing and sintering operations. The lower surface area of spherical particles as opposed to non-spherical particles of comparable size, makes spherical particles easier to mix with binders and easier to dewax.

Some preferred refractory metal based materials which can be produced by this invention are tungsten metal, tungsten heavy alloys, molybdenum alloys containing one or more elements selected from the group consisting of titanium, zirconium, and hafnium, tungsten alloyed with rhenium, molybdenum alloyed with rhenium. For purposes of illustration, the following are given as preferred materials of this invention with the constituents being expressed in weight units: (1) tungsten alloyed with about 25% rhenium, (2) tungsten alloyed with silver or copper, (3) heavy tungsten alloys containing from about 70% to about 97% tungsten alloyed with either copper and nickel or iron and nickel plus additional elements, (4) molybdenum alloyed with from about 0.01% to about 0.04% carbon, from about 0.40 to about 0.55% titanium, from about 0.06% to about 0.12% zirconium, less than about 0.0025% oxygen, less than about 0.0005% hydrogen, less than about 0.002% nitrogen, less than about 0.010% iron, less than about 0.002% nickel and less than about 0.008% silicon, (5) molybdenum alloyed with about 5%, 35% or 41% rhenium, (6) rhenium alloyed with tungsten and molybdenum, (7) tantalum alloyed with tungsten and/or hafnium for example containing about 2.5%, 7.5%, and 10% tungsten, and (8) niobium alloys containing about 10% hafnium and about 1% titanium.

The spherical particles of the present invention are different from those of the gas atomization process because the latter have caps on the particles whereas those of the present invention do not have such caps. Caps are the result of particle-particle collision in the molten or semi-molten state during the gas atomization event.

After cooling and resolidification, the resulting high temperature treated material can be classified to remove the major spherodized particle portion from the essentially non-spheroidized miner portion of particles and to obtain the desired particle size. The classification can be done by standard techniques such as screening or air classification. The unmelted minor portion can then be reprocessed according to the invention to convert it to fine spherical particles.

The powdered materials of this invention are essentially relatively uniform spherical particles which are essentially free of elliptical shaped material and essentially free of elongated particles having rounded ends.

These characteristics can be present in the particles made by the process described in European Patent Application No. WO8402864 as previously mentioned.

Spherical particles have an advantage over non-spherical particles in injection molding and pressing and sintering operations. The lower surface area of spherical particles as opposed to non-spherical particles of comparable size, and the flowability of spherical particles makes spherical particles easier to mix with binders and easier to dewax.

In applications in which powders are used directly as in conversion of tungsten to tungsten carbide, the more uniformly shaped spherical powder particles of this invention enable that uniformity to be achieved in materials produced therefrom.

In electrical contacts utilizing tungsten and silver, the uniform shaped material of this invention enables comparable electrical properties to be achieved using less silver because of the packing efficiency of the uniform particles and their lower surface area.

While there has been shown and described what are considered the preferred embodiments of the invention, it will be obvious to those skilled in the art that various changes and modifications may be made therein without departing from the scope of the invention as defined by the appended claims.

What is claimed:

1. A process comprising:

(a) forming an aqueous solution containing at least one refractory metal, (b) forming a solid reducible material having a major portion selected from the group consisting of reducible refractory metal salts, oxides and mixtures thereof, (c) reducing said solid reducible material to form refractory metal based powder particles, (d) entraining at least a portion of said refractory metal particles in a carrier gas, (e) feeding said entrained particles and said carrier gas into a high temperature zone and maintaining said particles in said zone for a sufficient time to melt at least about 50% by weight of said particles, and to form droplets therefrom and (f) cooling said droplets to form refractory metal based metallic particles having essentially a spherical shape and a majority of said particle having a size less than 20 micrometers.

2. A process according to claim 1 wherein said solution contains a water soluble acid.

3. A process according to claim 2 wherein said mineral acid is selected from the group consisting of hydrochloric, sulfuric and nitric acids.

4. A process according to claim 3 wherein said mineral acid is hydrochloric acid.

5. A process according to claim 3 wherein said solid reducible material is formed by evaporation.

6. A process according to claim 3 wherein said solid reucible material is formed by adjusting the pH to form the solid which is separated from the resulting aqueous phase.

7. A process according to claim 3 wherein said high temperature zone is created by a plasma touch.

8. A process according to claim 3 wherein said carrier gas is an inert gas.

9. A process according to claim 3 wherein essentially all of said metallic particles are melted.

10. A powdered material consisting essentially of spherical particles of a refractory metal based material, said powdered material being essentially free of elliptical shaped material and essentially free of elongated particles having rounded ends, said powdered material having an average particle size of less than about 20 microns.

11. A powdered material of claim 10 wherein said refractory metal based material is a metal selected from the group consisting of tungsten, molybdenum, niobium, tantalum, and rhenium.

12. A powdered material of claim 10 wherein said refractory metal based material is an alloy selected from the group consisting of tungsten alloys, molybdenum alloys, niobium alloys, tantalum alloys, and rhenium alloys.

13. A powdered material of claim 10 wherein said refractory metal based material is selected from the group consisting of tungsten metal, tungsten heavy alloys, molybdenum alloys containing of titanium, zirconium, and hafnium, tungsten alloyed with rhenium, and molybdenum alloyed with rhenium.

14. A powdered tungsten based material consisting essentially of spherical tungsten based powder, particles of an average size of less than about 20 microns.

* * * * *